US006637911B2

(12) United States Patent
Sittner

(10) Patent No.: US 6,637,911 B2
(45) Date of Patent: Oct. 28, 2003

(54) GRAVE MARKER AND LIGHTING APPARATUS

(76) Inventor: Jesse D. Sittner, 1542 Esther Dr., Arnold, MO (US) 63010

( * ) Notice: Subject to any disclaimer, the term of this patent is extended or adjusted under 35 U.S.C. 154(b) by 0 days.

(21) Appl. No.: 10/047,884

(22) Filed: Jan. 17, 2002

(65) Prior Publication Data

US 2003/0133294 A1 Jul. 17, 2003

(51) Int. Cl.[7] ..... F21V 33/06

(52) U.S. Cl. ..... 362/253; 362/183; 362/190; 362/806; 362/812; 52/104; 52/133

(58) Field of Search ..... 362/181, 183, 362/190, 191, 253, 806, 802, 812, 276; 70/124.5, 564; 52/103, 104, 101, 132, 133, 134; 315/149–159

(56) References Cited

U.S. PATENT DOCUMENTS 4,304,076 A * 12/1981 Splendora ..... 52/104
4,330,706 A * 5/1982 Lawenhaupt ..... 250/214 AL
5,255,170 A * 10/1993 Plamp et al. ..... 362/183
5,564,816 A * 10/1996 Arcadia et al. ..... 362/183
6,132,054 A * 10/2000 Rogers et al. ..... 362/86

* cited by examiner

*Primary Examiner*—Sandra O'Shea
*Assistant Examiner*—John Anthony Ward
(74) *Attorney, Agent, or Firm*—Kevin L. Klug

(57) ABSTRACT

A grave marker and lighting apparatus and method of use having an interchangeable illuminated form which may take the form of a lighted candle, a lighted Christmas tree, a lighted floral arrangement, a lighted flag, or any other illuminated form to commemorate an occasion or season. The apparatus having a photovoltaic cell to charge internal batteries and a photoconductive cell to signal electronic circuitry to turn on the illuminated form during nighttime hours. The apparatus further includes a unique plate extension mounting portion for attachment to a tombstone and base extending anchors for ground securing.

12 Claims, 5 Drawing Sheets

GRAVE MARKER AND LIGHTING APPARATUS

BACKGROUND OF THE INVENTION

The present invention relates in general to an apparatus and method for marking a grave or headstone and more particularly to an apparatus which mounts near a grave or onto a headstone and further contains one or more lighting elements with battery backup which automatically recharges with one or more photovoltaic cells. The present invention further represents an apparatus and method which allows a caretaker to remove, replace, and interchange said lighting elements with a variety of illuminated forms including but not limited to a lighted candle figure, lighted Christmas tree, lighted American flag or other lighted symbolic forms.

Often persons desire to place markers on or near the graves of their loved ones. Said markers often take the form of flowers or flags. Presently there are no known grave markers which take the form of an interchangeable illuminated candle, Christmas tree, American flag, or other illuminated forms which would show love and respect to the deceased or mark a special season or occasion. This is partly due to the need for power at the gravesite which is generally not available. The present invention provides both the lighted form interchangeability feature to commemorate seasons and special occasions and the electronic control circuitry including a rechargeable battery power supply necessary to provide illumination during darkness and one or more photovoltaic cells to recharge the battery power supply during daylight hours.

The essential elements of the preferred present art comprise a marker box, an interchangeable illuminated form having preferably one or more light emitting diodes, one or more photovoltaic cells, one or more rechargeable batteries, and the electronic control circuitry necessary to activate the illuminated form during darkness. Alternative embodiments incorporate one or more plate extensions for attachment to a tombstone or base extending anchors for ground securing, especially near a flush grave marking stone.

Accordingly, it is an object of the present invention to provide a grave marker and lighting apparatus which provides an interchangeable illuminated form which may take the lighted form of a candle, Christmas tree, American flag, floral arrangement, or other form which commemorates a season or occasion.

Another object of the present invention is to provide a grave marker and lighting apparatus which operates upon self contained power and which continuously recharges via one or more photovoltaic cells and which illuminates during darkness hours.

A further object of the present invention is to provide a grave marker and lighting apparatus which is portable and easily placed and/or attached upon a tombstone or near a gravesite.

SUMMARY OF THE INVENTION

To accomplish the foregoing and other objects of this invention there is provided a grave marker and lighting apparatus and method for commemorating seasons or occasions with an illuminated form. In its preferred embodiment, the apparatus comprises a marker box, an interchangeable illuminated form external to said marker box having one or more light emitting diodes or other low power lighting devices, one or more photovoltaic cells, one or more rechargeable batteries, and the electronic control circuitry within said marker box necessary to activate the illuminated form during darkness. Alternative embodiments further incorporate one or more plate extensions having attachments such as hook and loop fasteners for attachment to a tombstone. Further alternative embodiments utilize base extending anchors for ground securing, especially near a flush grave marking stone. Still further alternative embodiments utilize other low power lighting devices in place of the light emitting diode(s).

Many of the components of the present apparatus are commercially available and uniquely combined in such a fashion as to deliver the results described herein. The interchangeable illuminated form is uniquely manufactured for the apparatus and as aforesaid may take many illuminated forms such as a lighted candle, illuminated Christmas tree, illuminated American Flag, illuminated floral arrangement, or any other illuminated form which commemorates a season or special occasion.

In a preferred embodiment, the marker box is of sufficient size and shape to hold the electronic control circuitry internally, one or more photovoltaic cells internally or externally, one or more rechargeable batteries internally, a secure electrical connector internally and extending externally, and within said electrical connector, external to said marker box, an interchangeable illuminated form.

Although described more fully in the detailed description, the electronic control circuitry comprises a photodiode or photoconductive cell which is allowed to be illuminated from external to the marker box and thereby controls one or more transistors, relays, or switches to thereby turn on. the interchangeable illuminated form from the internal rechargeable battery. That is, when external light diminishes, the photodiode or photoconductive cell causes the electronic control circuitry to use the rechargeable battery power to illuminate the one or more light emitting diodes or other lighting devices in the interchangeable illuminated form.

The one or more photovoltaic cells are placed substantially in parallel with said one or more rechargeable batteries and continuously charge said rechargeable batteries during daylight hours. In a preferred embodiment, a rectifying diode is placed in series between said photovoltaic cells and said rechargeable batteries in order to minimize any battery discharge through the photocell during darkness hours.

The aforementioned electrical connector may utilize any commercially available or specially manufactured electrical connector provided that said connector securely holds the interchangeable illuminated form external to said marker box. Preferably said electrical connector is sealed in order to prevent moisture from entering the marker box.

In operation for a first embodiment, the caretaker first adhesively secures hook and loop fasteners to the face of a tombstone in such a position that the hook and loop fasteners will functionally align with the hook and loop fasteners on the plate extension of the marker box. The caretaker then sets the marker box upon the topmost portion of a tombstone and mates the hook and loop fasteners on the plate extension with the hook and loop fasteners adhesively attached on the plate extension. In operation for a second embodiment, the caretaker simply places the marker box on the ground near the grave and if desired further attaches base extending anchors to the marker box and pushes said anchors into the ground where placed. During darkness, the photodiode or photoconductive cell causes the electronic control circuitry to turn on the interchangeable illuminated form. During daylight, the photovoltaic cell charges the rechargeable battery for operation during darkness.

The art of the present invention may be manufactured from a variety of materials provided that said marker box materials and interchangeable illuminated form are capable of withstanding the external environment. Said materials include but are not limited to various metals and their alloys, woods, rubbers, plastics, or composites as required by the application. The electrical and electronic components described are readily recognized by those skilled in the art as commercially available.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
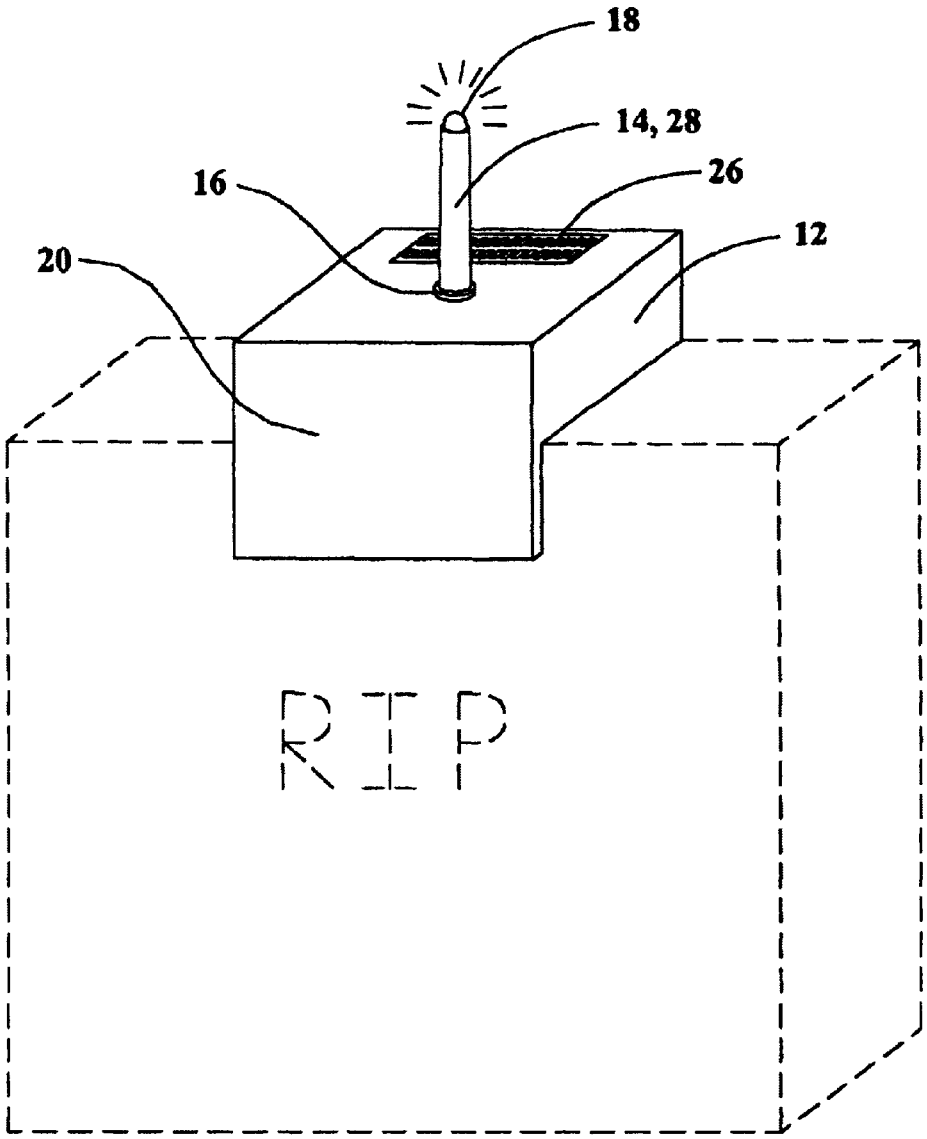
FIG. 1 is a front side plan view of a first embodiment of a grave marker and lighting apparatus showing a marker box, a plate extension, an interchangeable illuminated form as a candle having a lighted flame, and a photovoltaic window, all attached to a top of a tombstone.
Figure 2:
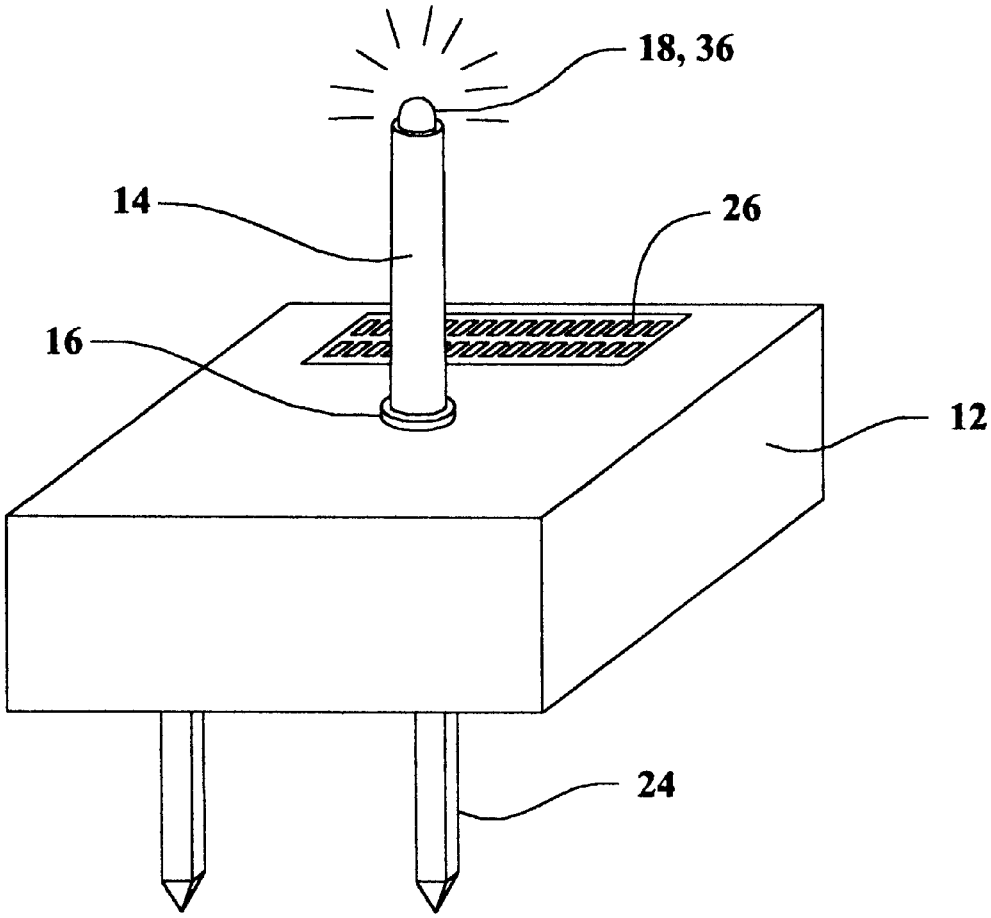
FIG. 2 is a front side plan view of second embodiment of a grave marker and lighting apparatus showing a marker box, an interchangeable illuminated form as a candle having a lighted flame, base extending anchors, and a photovoltaic.
Figure 3:
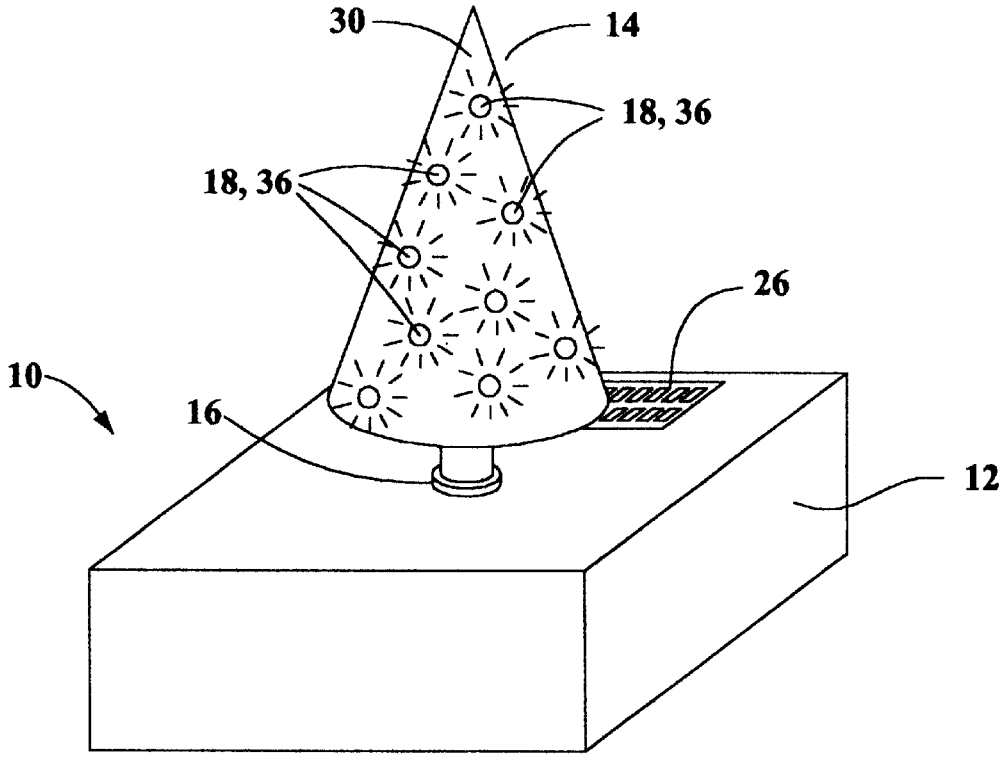
FIG. 3 is a front side plan view of third embodiment of a grave marker and lighting apparatus showing a marker box, an interchangeable illuminated form as a Christmas tree having a plurality of lighted elements, and a photovoltaic window.
Figure 4:
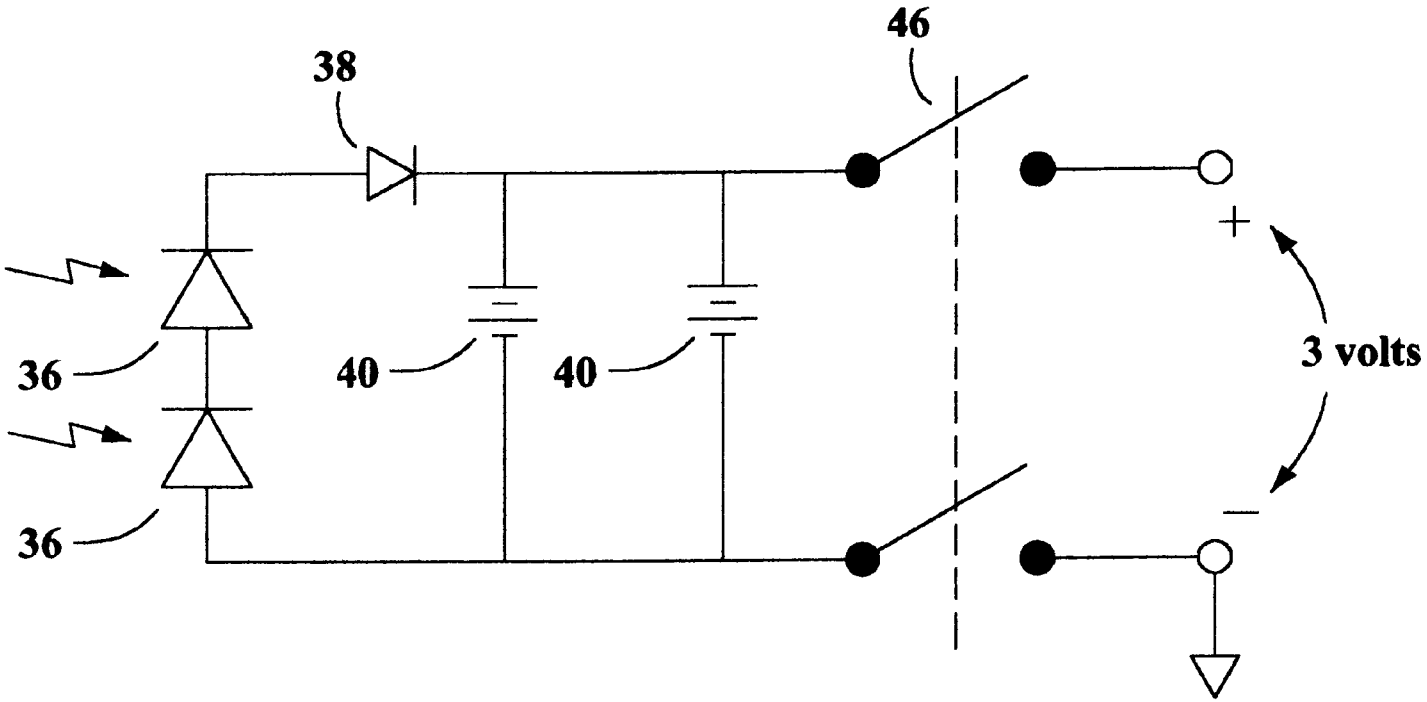
FIG. 4 is an electrical schematic diagram showing the connection of the one or more photovoltaic cells, the inline diode, the one or more rechargeable batteries, the switch, and the terminals which connect with the electronic control circuitry.
Figure 5:
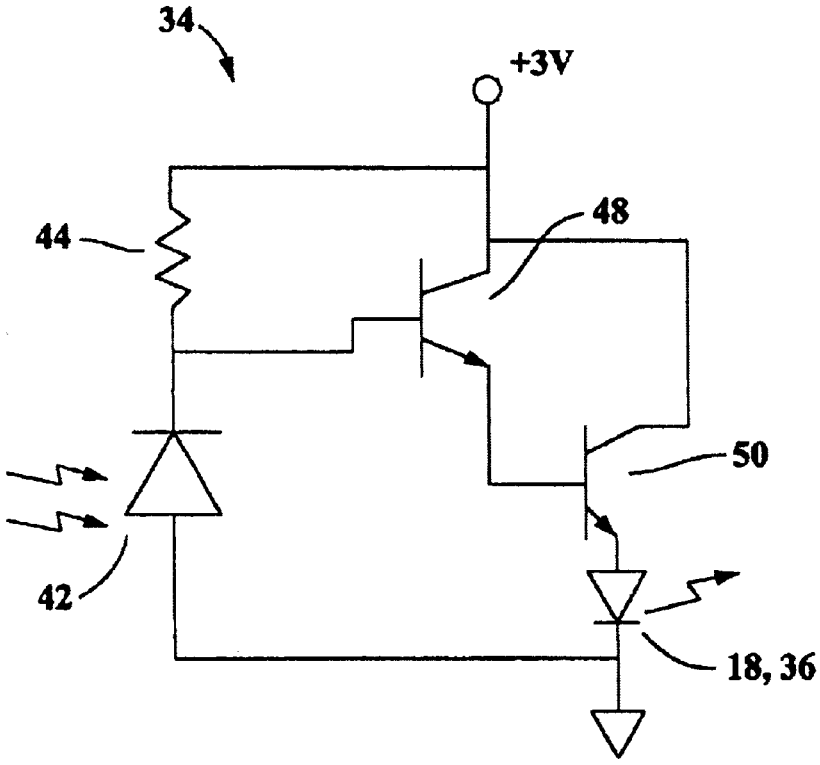
FIG. 5 is an electronic schematic diagram of the electronic control circuitry showing the light emitting diodes or other low power lighting devices, the first and second transistors, the bias resistor and the photodiode or photoconductive cell.

Referring now to the drawings, there is shown in FIGS. 1–3 various embodiments of a grave marker and lighting apparatus and in FIGS. 4 & 5 the preferred electrical and electronic circuitry for such. The grave marker and lighting apparatus 10 and method for interchangeably using various illuminated forms 14, 28, 30 is particularly adapted for commemorating a special occasion, event, or season near or on the grave of a loved one. The apparatus 10 further provides a unique and self contained method of lighting a grave without the need for an external power source. The apparatus 10 and its method of use further represents a unique combination of components which when assembled in the unique fashion shown and described herein provide the novel features and benefits disclosed. All component attachments, when necessary, are achieved with conventional fasteners such as screws, bolts, threads, pins, welds, adhesives, or rivets as desired by the manufacturer of the art described.

The drawings show various embodiments of the grave marker and lighting apparatus 10 comprising a marker box 12 having an inside and outside, an interchangeable illuminated form 14, such as an illuminated candle 28 or Christmas tree 30, an electrical connector 16, one or more light emitting diodes 18 or other low power lighting devices 36, one or more photovoltaic cells 36 having collective positive and negative terminals, one or more rechargeable batteries 40 having collective positive and negative terminals, along with the electronic control circuitry 34. The embodiment shown in FIG. 1 further shows a plate extension 20 on said marker box 12 which is utilized to attach said marker box 12 onto a top of a tombstone. FIG. 2 further shows a marker box 12 having base extending anchors 24 which allow said marker box 12 to be securely placed onto the ground near a grave or flush headstone. FIG. 3 also shows the grave marker and lighting apparatus 10 having an illuminated Christmas tree 30 which contains one or more light emitting diodes 18 or other low power lighting devices 36. FIG. 4 shows a preferred embodiment of the one or more photovoltaic cell 36 connections with an inline diode 38 and the one or more rechargeable batteries 40 and the on/off switch 46 which form the power for the electronic control circuitry 34. FIG. 5 shows a preferred embodiment of the electronic control circuitry 34, including the illuminating light emitting diodes 18 or other low power lighting devices 36.

As aforesaid, a novel feature of the present invention is the interchangeable illuminated forms 14 mounted external to the marker box 12 which may take many forms including but not limited to illuminated candles, illuminated Christmas trees, illuminated floral arrangements, or illuminated flags all of which are attached externally with a secure electrical connector 16. Said secure electrical connector 16 may take many forms such as an industry standard BNC connector, RG-59 connector, screw and socket, push and rotate connector, threaded connector, or simply a frictional connector, provided it is capable of allowing a completed circuit to and hold said illuminated form 14. The one or more light emitting diodes 18 or other low power lighting devices 36 are hardwired internally or externally to said interchangeable illuminated form 14 in such a manner as to allow the illumination to be seen externally to said illuminated form 14. In a preferred embodiment, said secure electrical connector 16 seals said marker box 12 from external moisture migrating to the interior and further is of sufficient strength to securely hold said interchangeable illuminated form 14 external to said marker box 12.

The plate extension 20 represents a plate extending downward from said marker box 12 and provides additional securing means when the caretaker desires to attach said grave marker and lighting apparatus 10 to the top of a tombstone. Preferably, the caretaker would utilize hook and loop fasteners on the side of said plate extension 20 which contacts said tombstone face to secure said apparatus 10 to the tombstone. Alternative embodiments may utilize a plurality of other methods such a adhesives, anchors, screws, pins, or bolts to attach said plate extension 20. Further alternative embodiments may forego using the plate extension 20 altogether and simply attach the base of said marker box 12 to the top of a tombstone with hook and loop fasteners, adhesives, or the aforementioned anchors and fasteners.

Alternative embodiments may utilize base extending anchors 24 which are attached on the base of and below said marker box 12. Said base extending anchors 24 may take the form of spikes which are bolted or adhesively attached or otherwise connected to said marker box 12 or any other form of protrusion which may be pushed into the ground near or on a grave. Said anchors 24 help secure the apparatus 10 to the ground and prevent movement due to the external elements.

In the preferred embodiment, the marker box 12 contains a photovoltaic window 26 in the form of a transparent or open portion through which sunlight or other illumination may shine onto the one or more photovoltaic cells 36 and the photodiode or photoconductive cell 42. Alternative embodiments may place the one or more photovoltaic cells 36 and the photodiode or photoconductive cell 42 externally to said marker box 12.

The one or more photovoltaic cells 36 comprise two four volt cells which are placed in series to produce a total of eight volts in the preferred embodiment, typically each a PCB-60608B or equivalent. The photovoltaic cells 36 when combined have a collective positive terminal and a collective negative terminal. Although eight volts is a higher voltage than the typically three volt rechargeable two "D" cell battery 40 which said photovoltaic 36 keeps charged, the internal resistance of the photovoltaic 36 assures that the rechargeable battery 40 is not overcharged. In the preferred embodiment, the photovoltaic cell 36 combination positive terminal connection is connected in series with the anode of a rectifying inline diode 38, typically a 1N4001 or equivalent, which serves to assure that no reverse current flows through said photovoltaics 36. The cathode of said inline diode 38 is connected to the positive terminal of the rechargeable battery 40, said rechargeable battery preferably of three volts potential. Preferably said rechargeable battery comprises two three volt cells in parallel (two series "D" cells in parallel) but may comprise any form or combination of rechargeable cells which may power the electronic circuitry. The cells when combined as the rechargeable battery 40 have a collective positive terminal and a collective negative terminal. The anode of the photovoltaic 36 combination and negative terminal of said battery are commonly connected. The positive and negative terminals of said rechargeable battery 40 are preferably connected with a double pull double throw switch 46 with the electronic control circuitry 34 to control the on/off power to the electronic control circuitry 34. Alternative embodiments may utilize one or more photovoltaic cells 36 with or without the inline diode 38 provided said photovoltaics 36 are of sufficient potential to drive the rechargeable battery(s) 40.

The preferred embodiment of the electronic control circuitry 34 utilizes the power from said rechargeable battery (s) 40 and is placed across the voltage therefrom, preferably three volts. The preferred embodiment of said electronic control circuitry 34 comprises a first transistor 48 and a second transistor 50 combined in a darlington fashion with the collectors common to the positive lead of said power source, the emitter of the first transistor 48 connected to and feeding the base of the second transistor 50, and the emitter of the second transistor 50 connected to and feeding the anode(s) of said one or more light emitting diodes 18 with the cathodes of said one or more light emitting diodes 18 connected to the negative terminal of said battery 40 through said switch 46. If low power lighting devices 36 are utilized instead of said light emitting diodes 18, they are bipolar devices which may connected in any orientation between the aforesaid second transistor 50 emitter and the negative power supply. Alternative embodiments may utilize a single transistor, relay, or voltage/current controlled switch, in place of said darlington arrangement provided that the gain or beta of said device is sufficiently high to ensure collector-emitter saturation or complete turn on when the first transistor 48 equivalent base in energized. Said transistors 48, 50 may be any industry standard transistors such as a 2N3904 or 2N2222 provided that they combined have a sufficiently large beta to assure turn on from the bias resistor 44 and an ability to handle the current necessary for illumination.

The base of the first transistor 48 is fed and connected to a second terminal of a bias resistor 44. A first terminal of said bias resistor 44 is connected with said positive terminal through said switch 46 of the rechargeable battery 40. In a preferred embodiment, said bias resistor 44 is approximately 100 kilo-ohms. Alternative embodiments may reduce or increase the value of said bias resistor 44 provided that said bias resistor is of sufficiently small value to allow the transistor 50 or other relay or voltage controlled switch to be fed with a large enough base current and voltage combination to provide the drive current necessary to drive the lighting devices 18, 36. Further alternative embodiments, may utilize a variable resister in the place and stead of said bias resistor 44 to provide more complete current control to the lighting devices 18, 36. In completion of the electronic control circuitry 34, a photodiode or photoconductive cell 42 is connected from said bias resistor 44 and second terminal/first transistor 48 base connection to the negative terminal of the battery 40 through said switch 46. The photodiode 42 is physically placed within said marker box 12 in a preferred embodiment so that it may be illuminated via external light, preferrably through said photovoltaic window 26. Alternative embodiments need not use the switch 46.

When illuminated, said photodiode/photoconductive cell 42 shunts the current normally flowing through the darlington transistor 48, 50 combination and allows said transistor 48, 50 combination to go into cutoff, thereby turning off the lighting devices 18, 36. If not illuminated, the photodiode/photoconductive cell 42 minimizes the current flowing through it and thereby allows the current flowing from the bias resistor 44 to flow through the base of the first transistor 48 and turn on the darlington pair 48, 50. Due to the large gain of the darlington pair 48, 50, the second transistor 50 will operate near or in a saturation mode, thereby allowing as much current as required to power the light emitting diodes 18 or the other low power lighting devices 36. The same theoretical description applies if a relay or voltage controlled switch is substituted for said darlington pair 48, 50.

In operation, the user first places and locates the grave marker and lighting apparatus 10 as previously described. The user then turns on the switch 46 to allow the apparatus 10 to begin its cyclic functioning. During daylight hours, the photovoltaic cells 36 charge the rechargeable battery 40 and the electronic control circuitry 34 turns off the one or more light emitting diodes 18 or other low power lighting devices 36 as earlier described. During darkness hours, the photovoltaic cells 36 obviously cease charging, and the electronic control circuitry 34 turns on the one or more light emitting diodes 18 or other low power lighting devices 36 by utilizing the stored power within the rechargeable battery 40. The cycle continues as,the day/night cycle continues.

As described, the present art is shown with unique interchangeable illuminated forms 14 having one or more light emitting diodes 18 or other low power lighting devices 36. Numerous commercially available electrical and electronic components are described with a unique order of assembly and connection in conjunction with the apparatus and method 10 of the present art.

From the foregoing description, those skilled in the art will appreciate that all objects of the present invention are realized. A grave marker and lighting apparatus for continuously placing light near or on a grave during darkness hours and further commemorating a special occasion or season with the interchangeable illuminated forms. Those skilled in the art will appreciate that the art of the present invention as selected provides a the aforesaid lighting in a self powered and self contained apparatus. Those skilled in the art will further appreciate that the art of the present invention provides interchangeability of illuminated forms to commemorate special occasions or seasons, all in a way which heretofore was unavailable.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A grave marker and lighting apparatus comprising:

a marker box having an inside and an outside; and one or more batteries inside said marker box, said batteries having a collective positive terminal and a collective negative terminal; and an electronic control circuitry inside said marker box; and an electrical connector mounted onto said marker box and electrically connecting said electronic control circuitry from said inside to said outside; and an interchangeable illuminated form remove ably connected with said electrical connector outside said marker box;

said interchangeable illuminated form having one or more lighting devices mounted with said interchangeable illuminated form and electrically connected from said interchangeable illuminated form and through said electrical connector to said electronic control circuitry;

whereby said electronic control circuitry powers from said one or more batteries and turns on said one or more lighting devices thereby illuminating the interchangeable illuminated form.

2. The grave marker and lighting apparatus as set forth in claim 1 further comprising:

one or more photovoltaic cells having a collective positive and a collective negative terminal and illuminated from the outside of said marker box and substantially having said photovoltaic collective positive terminal connected with the collective positive terminal of said batteries and said photovoltaic collective negative terminal substantially connected with the collective negative terminal of said batteries, whereby illumination of said photovoltaic cells charge said batteries.

3. The grave marker and lighting apparatus as set forth in claim 2 further comprising:

one or more rectifier inline diodes connected between said photovoltaic collective positive terminal and the collective positive terminal of said batteries, whereby the anode of said inline diode is connected to said photovoltaic collective positive terminal and the cathode of said inline diode is connected with said collective positive terminal of said batteries;

whereby said batteries are not allowed to discharge through said photovoltaic cells.

4. The grave marker and lighting apparatus as set forth in claim 2 further comprising:

a photoconductive cell illuminated from outside said marker box and connected with an electronic control circuitry; and said electronic control circuitry connected across the collective positive terminal to the collective negative terminal of said batteries, whereby said electronic control circuitry turns off said lighting devices when said photoconductive cell is illuminated and turns on said lighting devices when not illuminated.

5. The grave marker and lighting apparatus as set forth in claim 1 further comprising:

a plate extension extending from said marker box, whereby said marker box may be placed onto a tombstone and said plate extension attaches to a rear or a front face of said tombstone.

6. The grave marker and lighting apparatus as set forth in claim 1 further comprising:

one or more base extending anchors attached and extending from said marker box, whereby said anchors may be pressed into a ground position near or on a grave and thereby secure said marker box.

7. The grave marker and lighting apparatus as set forth in claim 1;

said interchangeable illuminated form removeably connected with said electrical connector outside said marker box with a threaded connection.

8. The grave marker and lighting apparatus as set forth in claim 4, said electronic control circuitry further comprising:

a first transistor and a second transistor combined in a darlington fashion with a collector of each of said first and second transistor connected with the collective positive terminal of said battery; and an emitter of the first transistor connected to and feeding a base of the second transistor; and an emitter of the second transistor connected to and feeding a first terminal of the one or more lighting devices; and a second terminal of said one or more lighting devices connected with the collective negative terminal of said battery; and a base of the first transistor connected to a second terminal of a bias resistor and a first terminal of said bias resistor connected with said collective positive terminal of said battery; and said photoconductive cell connected from said second terminal of said bias resistor to the collective negative terminal of said batteries, whereby said photoconductive cell shunts current from the base of the first transistor when illuminated thereby turning off the first and second transistor and the one or more lighting devices.

9. The grave marker and lighting apparatus as set forth in claim 4 said photoconductive cell comprising:

a photodiode having an anode connected with the collective negative terminal of said batteries.

10. The grave marker and lighting apparatus as set forth in claim 1 said one or more lighting devices comprising:

one or more light emitting diodes having a cathode connected with the collective negative terminal of said batteries.

11. The grave marker and lighting apparatus as set forth in claim 4 further comprising:

a switch connected between said collective positive terminal of said batteries and said electronic control circuitry, whereby said switch allows the electronic control circuitry to be turned on or off.

12. A method for marker and lighting a grave, the steps comprising:

forming a marker box having an electrical connector, a battery, a photovoltaic cell, a photoconductive cell, and an electronic control circuitry; and placing an interchangeable illuminated form into said electrical connector in such a manner that said form may be removed and replaced with a second interchangeable illuminated form; and placing said marker box near a grave; and allowing sunlight to illuminate said photovoltaic cell and said photoconductive cell whereby said photovoltaic cell charges said battery when illuminated and said photoconductive cell signals said electronic circuitry to illuminate said interchangeable illuminated form when said photoconductive cell is not illuminated.

* * * * *